US010811772B2

(12) United States Patent
Mitchell et al.

(10) Patent No.: US 10,811,772 B2
(45) Date of Patent: Oct. 20, 2020

(54) CONCENTRIC, CO-LOCATED AND INTERLEAVED DUAL BAND ANTENNA ARRAY

(71) Applicant: U.S. Army Research Laboratory, Adelphi, MD (US)

(72) Inventors: Gregory A. Mitchell, Washington, DC (US); Amir I. Zaghloul, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 102 days.

(21) Appl. No.: 16/133,180

(22) Filed: Sep. 17, 2018

(65) Prior Publication Data

US 2019/0089057 A1 Mar. 21, 2019

Related U.S. Application Data

(60) Provisional application No. 62/559,899, filed on Sep. 18, 2017.

(51) Int. Cl.

| | |
|---|---|
| ***H01Q 21/00*** | (2006.01) |
| ***H01Q 5/35*** | (2015.01) |
| ***H01Q 21/06*** | (2006.01) |
| ***H01Q 9/04*** | (2006.01) |
| ***H01Q 5/42*** | (2015.01) |
| ***H01Q 21/28*** | (2006.01) |

(52) U.S. Cl.
CPC ..... *H01Q 5/35* (2015.01); *H01Q 5/42* (2015.01); *H01Q 9/0435* (2013.01); *H01Q 21/065* (2013.01); *H01Q 21/28* (2013.01); *H01Q 9/0464* (2013.01)

(58) Field of Classification Search
CPC H01Q 5/35; H01Q 5/42; H01Q 21/28; H01Q 21/065; H01Q 9/0435
USPC ..... 343/893
See application file for complete search history.

(56) References Cited

U.S. PATENT DOCUMENTS

| | | | | |
|---|---|---|---|---|
| 8,283,619 | B2 * | 10/2012 | Novack | H01Q 1/248 250/208.2 |
| 10,148,002 | B2 * | 12/2018 | McGough | H01Q 1/246 |
| 2008/0111757 | A1 * | 5/2008 | Bisiules | H01P 5/103 343/799 |
| 2016/0041095 | A1 * | 2/2016 | Rothberg | G01N 21/648 506/4 |
| 2017/0331186 | A1 * | 11/2017 | Linn | H01Q 21/0012 |
| 2018/0076521 | A1 * | 3/2018 | Mehdipour | H01Q 3/26 |

* cited by examiner

*Primary Examiner* — Huedung X Mancuso
(74) *Attorney, Agent, or Firm* — Alan I. Kalb

(57) ABSTRACT

An antenna array comprising a plurality of concentric low frequency elements, where each low frequency element circumscribes a first high frequency element; and a plurality of second high frequency elements interleaved with the plurality of concentric low frequency elements to maintain optimal electrical spacing between both the low frequency elements and the high frequency elements at two disparate frequencies.

2 Claims, 13 Drawing Sheets

CONCENTRIC, CO-LOCATED AND INTERLEAVED DUAL BAND ANTENNA ARRAY

RELATED APPLICATIONS

This application claims the benefit of U.S. Provisional Application No. 62/559,899, filed Sep. 18, 2017, which is herein incorporated by reference in its entirety.

GOVERNMENT INTEREST

The embodiments herein may be manufactured, used, and/or licensed by or for the United States Government without the payment of royalties thereon.

BACKGROUND

Field of the Invention

Embodiments of the invention generally relate to antenna arrays and, more particularly, to a concentric, co-located and interleaved dual band antenna array.

Description of the Related Art

As wireless devices continue to move towards reduced weight and smaller footprint, the need for scalable multi-band antenna technology continues to grow. Incorporating the functionality of multiple antennas into a single configuration greatly reduces the array footprint by reducing the number of antennas required for multiple tasks.

In multiband applications, ranging from personal wireless communication to space-based applications, the overall footprint and weight of the system must be minimized. Strict weight restrictions, coupled with the increased complexity of a payload's radio frequency (RF) system, have led to space-based systems becoming an emerging area of multi-band system design. For example, dual-band operation is now a necessity for systems employing frequency diversity as a compensation mechanism for signal fading; in this application, when the power margin for a signal is compromised because of rain-based atmospheric attenuation, communication traffic is transferred to a lower-frequency band that presents lower signal attenuation. Additionally, wireless access points and laptops are both trending towards antennas capable of operating in multiple frequency bands in order to support multiple protocols. The 2.4 GHz industrial, scientific and medical (ISM) band is quickly growing in popularity for wireless communications devices because of its use in Bluetooth technology and 802.11b/g protocol. For higher data rates, the frequency band from 5.15 to 5.85 GHz is often used, and the 802.11a protocol operates within the 5.2 GHz ISM band. Many of these applications utilize circular polarization (CP) owing to its ability to allow flexible orientation in the plane of the transmitter and receiver antennas and to reduce multipath effects that can lead to signal fading.

Previous concentric dual band antenna arrays designs utilized low frequency antenna elements (e.g., S-band) each surrounding high frequency antenna element (X-band) formed upon a single, uniform substrate. For optimal functionality, the element spacing for both elements should be near one-half wavelength of the element's respective operating frequency. However, in these concentric designs, it is only possible to attain the low frequency antenna element spacing at less than one-half wavelength apart and the high frequency element spacing at well over one-half wavelength. As a result, the arrays have shown limited usefulness due to poor isolation between antenna elements and malformed sidelobes and grating lobes in the antenna gain pattern. Additionally, these concentric element arrays only utilize circular polarization.

Therefore, it is desirable to have a dual-band antenna array capable of operating with dual-orthogonal polarization in each frequency band provides flexibility to a system by reducing the number of antennas required to complete multiple tasks. Additionally, if the element is realized in printed circuit board technology, it would provide a low profile and lightweight design that could be easily integrated with the accompanying electronics in the system.

SUMMARY

Embodiments of the present invention include an antenna array comprising a plurality of concentric low frequency elements, where each low frequency element circumscribes a first high frequency element; and a plurality of second high frequency elements interleaved with the plurality of concentric low frequency elements. Additional embodiments include having the low frequency elements each comprise two orthogonally positioned input ports enabling the low frequency elements to transmit and/or receive orthogonal, linearly polarized signals, and further include having the first and second high frequency elements each comprise two orthogonally positioned input ports enabling the first and second high frequency elements to transmit and/or receive orthogonal, linearly polarized signals.

Figure 1:
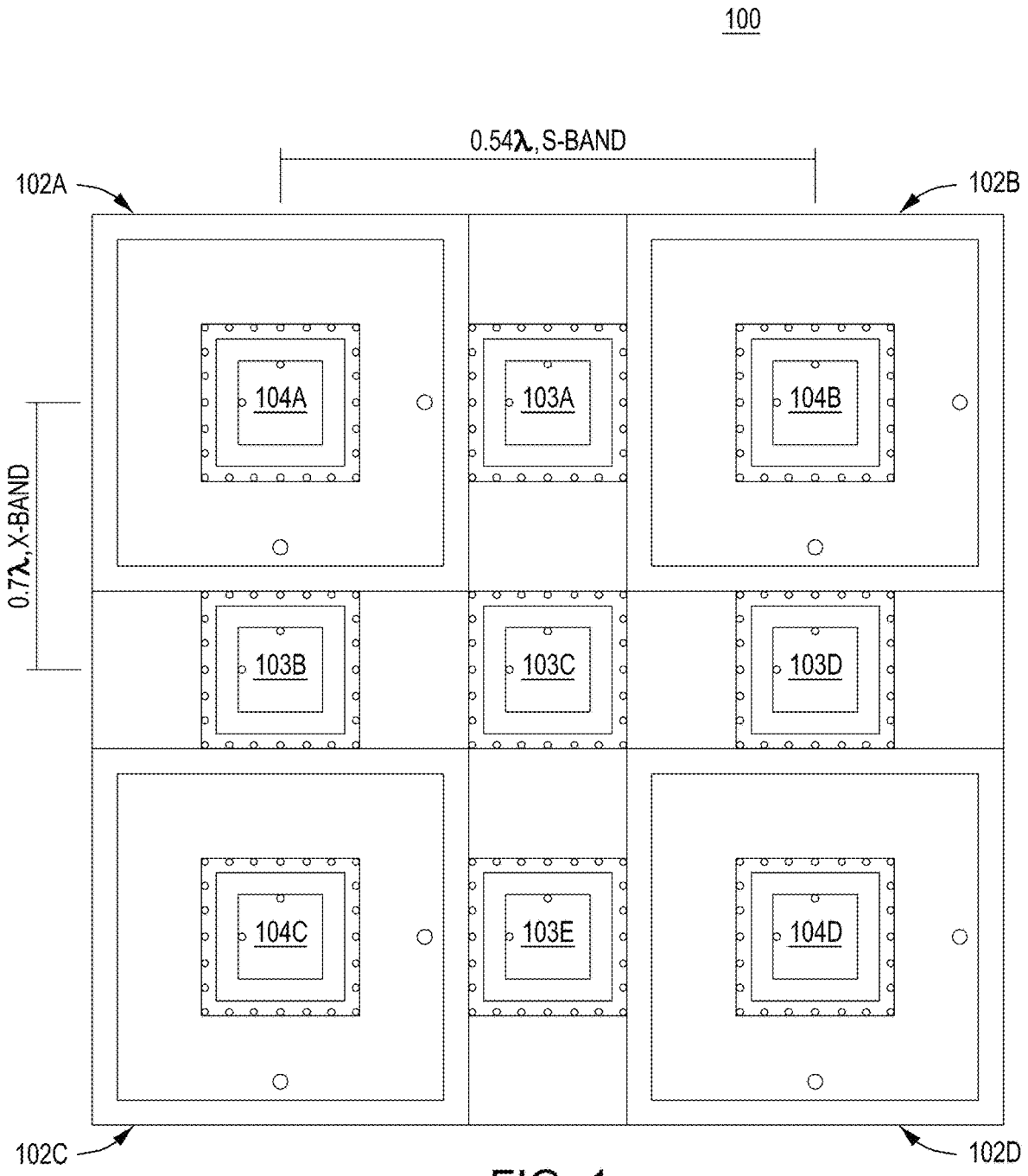
FIG. 1 is a top, plan view of an concentric, co-located, and interleaved antenna array in accordance with one embodiment of the invention.

A more complete appreciation of the invention will be readily obtained by reference to the following Detailed Description and the accompanying drawings in which like numerals in different figures represent the same structures or elements. The representations in each of the figures are diagrammatic and no attempt is made to indicate actual scales or precise ratios. Proportional relationships are shown as approximates.

DETAILED DESCRIPTION

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention. Rather, these embodiments are provided so that this disclosure will be thorough and complete, and will fully convey the scope of the invention to those skilled in the art. In the drawings, the dimensions of objects and regions may be exaggerated for clarity. Like numbers refer to like elements throughout. As used herein the term "and/or" includes any and all combinations of one or more of the associated listed items.

The terminology used herein is for the purpose of describing particular embodiments only and is not intended to limit the full scope of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, etc. may be used herein to describe various ranges, elements, components, regions, layers and/or sections, these elements, components, regions, layers and/or sections should not be limited by these terms. For example, when referring first and second ranges, these terms are only used to distinguish one range from another range. Thus, a first element, component, region, layer or section discussed below could be termed a second element, component, region, layer or section without departing from the teachings of the present invention.

As may be used herein, the terms "substantially" and "approximately" provide an industry-accepted tolerance for its corresponding term and/or relativity between items. Such an industry-accepted tolerance ranges from less than one percent to ten percent and corresponds to, but is not limited to, component values, angles, et cetera. Such relativity between items ranges between less than one percent to ten percent. As may be used herein, the term "substantially negligible" means there is little relative difference, the little difference ranging between less than one percent to ten percent.

As may be used herein, the term "significantly" means of a size and/or effect that is large or important enough to be noticed or have an important effect.

As used herein the terminology "substantially all" means for the most part; essentially all.

This description and the accompanying drawings that illustrate inventive aspects and embodiments should not be taken as limiting—the claims define the protected invention. Various changes may be made without departing from the spirit and scope of this description and the claims. In some instances, well-known structures and techniques have not been shown or described in detail in order not to obscure the invention. Additionally, the drawings are not to scale. Relative sizes of components are for illustrative purposes only and do not reflect the actual sizes that may occur in any actual embodiment of the invention. Like numbers in two or more figures represent the same or similar elements. Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

An embodiment of the present invention comprises a multi-band, dual polarization, low profile, and light weight antenna array having concentric, co-located and interleaved antenna elements. The multi-band antenna operates in a low frequency (e.g., S-band) and a high frequency (e.g., X-band). Embodiments of the invention utilizes a concentric substrate approach, where a high frequency element is formed of a first electrode atop a first substrate having a first dielectric constant that is inserted into an aperture in a second substrate having a second dielectric constant. The low frequency element is formed of a second electrode atop the second substrate such that the second substrate and second electrode circumscribe the first electrode and first substrate. Other high frequency elements are interleaved between the concentric elements. Using this interleaved, concentric substrate/electrode approach improves the layout and performance for a dual band array. One embodiment comprises a dual band, dual polarization array that operates simultaneously in the S- and X-bands having selectable vertical and/or horizontal polarization for each band. As an example, although the present invention is not limited to this design, embodiments may comprise a simple co-located array of X- and S-band elements (e.g., 2×2 S-band elements and 3×3 X-band elements, a more complex arrangement of a 4×4 element array at S-band and 8×8 element array at X-band, or various combinations of high and low frequency elements as described below. S- and X-band frequencies are used as examples. Those skilled in the art have the ability to scale the concepts taught here to achieve operational arrays at other frequencies.

Embodiments of the present invention encompasses the geometry of a multi-mode, dual-band planar antenna array comprising co-located, concentric and interleaved radiating elements, for grating lobe suppression. The array operates in two frequency bands with two independent modes of polarization for each frequency band. The dual-band operation necessitates different electrical spacing between the radiating elements corresponding to each band. The electrical spacing may be optimized using the same array lattice, alternating between the dual-band radiating elements and single higher band radiating elements. The enabling technology for the optimized spacing comprises two concentric substrates that shrinks the size of the low frequency element with respect to the high frequency element.

FIG. 1 depicts an embodiment of the invention organized as a 2×2 low frequency/3×3 high frequency element array 100, where each low frequency element 102A, 102B, 102C, and 102D, collectively elements 102, circumscribe a high frequency element 104A, 104B, 104C, and 104D (elements 104). An element is defined as dielectric substrate sandwiched between an active electrode and a ground plane electrode. The electrodes may be applied to the substrate using well-known printed-circuit board manufacturing techniques. Interleaved between the low frequency elements 102A, 102B, 102C, and 102D are additional high frequency elements 103A, 103B, 103C, 103D, and 103E. The details regarding the structure of each element 102, 103, and 104 are described below with respect to FIGS. 2A, 2B, 2C, 2D and 2E. In one embodiment, the antenna array 100 supports multi-band utilization, where the high frequency is in the X-band (e.g., 8 to 12 GHz) and the low frequency is in the S-band (e.g., 2-4 GHz).

Typically, an optimized array would have the centers of the antenna elements spaced one-half of a wavelength apart from each other. Since this is not physically possible at two frequencies for concentric elements, an embodiment of the invention uses a substrate with a different dielectric constant for each element. For X-band and S-band, when using differing substrates (e.g., Rogers 5880 (dielectric constant of 2.2) for the high frequency element 102 and Rogers 3006 (dielectric constant of 6.15) for the low frequency element, the spacing of the low frequency elements is $0.54\lambda_L$ at S-band and $0.7\lambda_H$ for the high frequency elements at X-band, where $\lambda_L$ is a wavelength of a nominal operating frequency of the low frequency element and $\lambda_H$ is a wavelength of a nominal operating frequency of the high frequency elements. Information about the Rogers substrate material is available from Rogers Corporation at www.rogerscorp.com.

FIGS. 2A, 2B, 2C and 2D together depict a portion of the antenna array of FIG. 1 in accordance with one embodiment of the invention. Specifically, FIGS. 2A, 2B, 2C and 2D depict a single low frequency element 102 and three adjacent high frequency elements 103 in top, cross section, bottom and partially exploded views, respectively. To best understand the invention, FIGS. 2A, 2B, 2C and 2D should be viewed simultaneously while reading the following description.

In FIGS. 2A, 2B, 2C and 2D, the low frequency element 102 comprises a low frequency dielectric substrate 216 sandwiched between a low frequency electrode 250 and a ground plane electrode 204. The substrate 216 and electrode 250 circumscribe an opening 258 in the substrate 216. The ground plane electrode contiguously extends across the entire bottom of the array (except for openings 220 and 222 that enable feed pins 210 and 212 to pass through the ground plane without shorting). In addition, the ground plane has openings 2017 for the fence pins 206. The fence pins 206 are than conductively coupled to the ground plane using, for example, solder 209. The high frequency element 104 fits into the opening 258 much like a puzzle piece fits into a puzzle (See FIG. 2D for details). The high frequency element 104 (once assembled) comprises a high frequency electrode 254, a high frequency dielectric substrate 218 and a portion of the ground plane 204 that falls beneath the substrate 218. The high frequency substrate 218 extends beyond the edge of the electrode 254 to create a gap 252 between the low and high frequency electrodes 250 and 254.

The inner edge 202 of the low frequency electrode 250 is tied to a bottom ground plane electrode 204 by, in one embodiment, a plurality of conductive pins 206 that extend from the low frequency electrode 250 to the ground plane 204. Each pin passes through an opening 207 in the ground plane and is then conductively coupled by, for example, soldering 209, to the ground plane 204. In one embodiment, a total of 24 pins 206 are shown to form a "fence," where the pins are spaced less than $\lambda/10$ apart. In another embodiment, the circumferential wall 259 of openings 258 may be metalized to form a solid wall to create a conductive barrier. The use of a fence of pins 206 or a conductive (metallized) wall 259 facilitates suppression of surface waves in the substrates. A similar set of pins 206 (or a conductive wall 259) tie a circumferential electrode 256 surrounding the high frequency element 103 to the ground plane electrode 204.

Figure 2A:
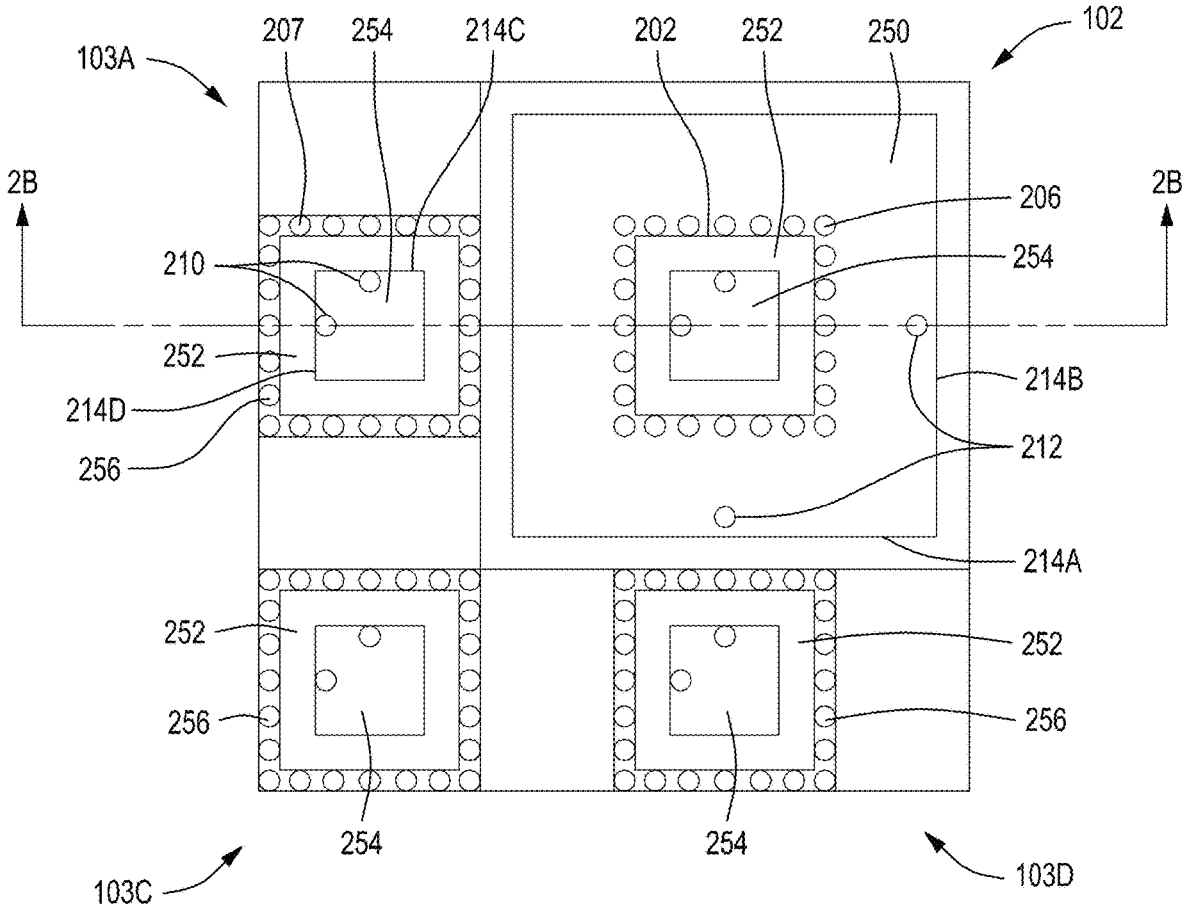
FIG. 2A is a top plan view of the details of a portion of the antenna array of FIG. 1.
Figure 2B:
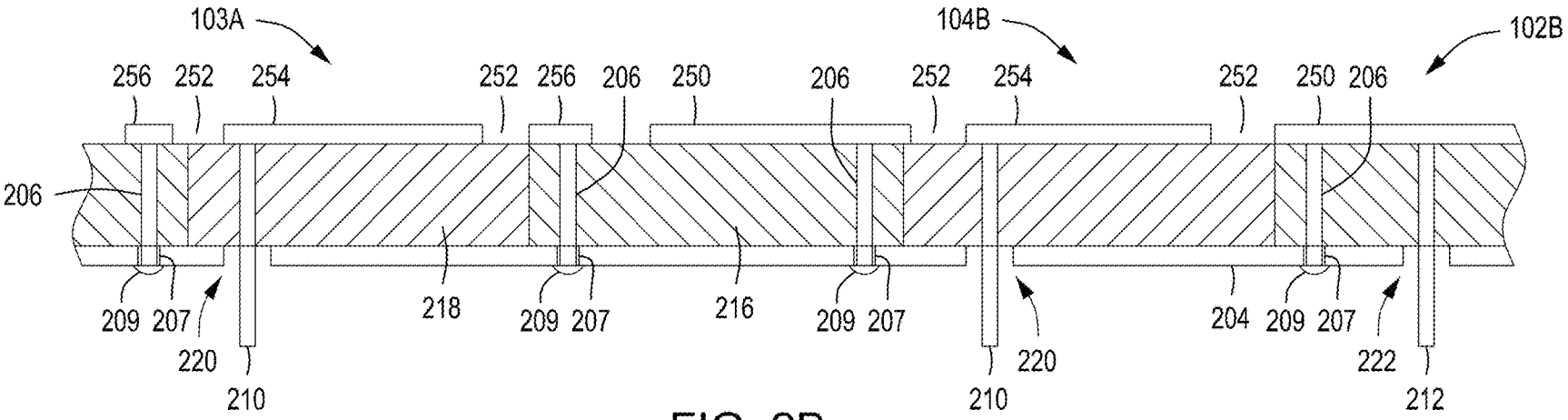
FIG. 2B depicts a cross-sectional view of the portion of the antenna array of FIG. 2A taken along line 2B-2B.
Figure 2C:
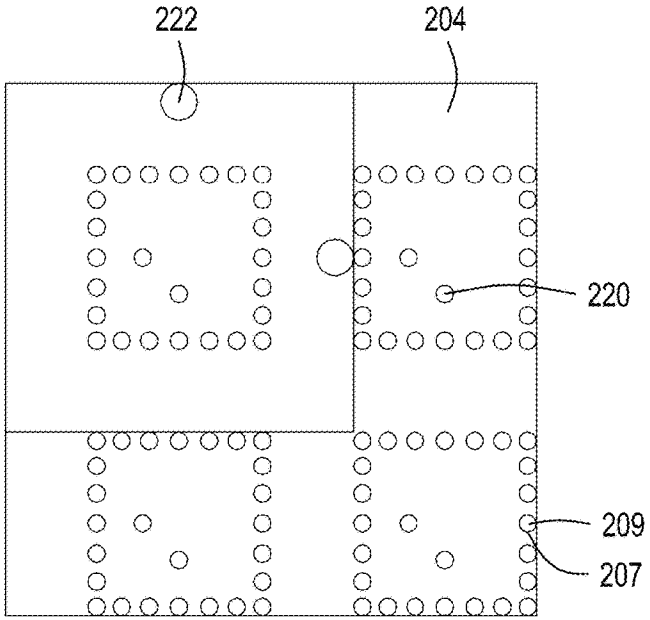
FIG. 2C depicts a bottom plan view of the portion of the antenna array of FIG. 2A.

A plurality of pin feeds 210 are arranged as two pin feeds in low frequency electrode 250 of the low frequency element 102 and two pin feeds 212 are positioned in the high frequency electrode 254 of the high frequency elements 104 and 103. The feeds 212 are located near adjacent edges 214A and 214B, at the center of the edges, to facilitate driving both vertical and horizontal polarizations for the low frequency band. Similarly, the feeds 210 are located on adjacent edges 214C and 214D, at the center of the edges, to facilitate driving both vertical and horizontal polarizations for the high frequency band. As such, the array can be operated with flexible transmission or reception of orthogonal linear combinations of polarizations (e.g., HH, HV, VH, and VV) in both high and low frequency bands. In other embodiments, the high and/or low frequency elements may also be operated with circular polarization in one or both frequency bands, or with a combination of circular and linear polarization. In addition, each antenna array element can be driven independently to produce a phase steerable array. FIG. 2C depicts a bottom view of the antenna element 102, where openings 220, 222, and 207 are formed in the ground plane electrode to facilitate corresponding pin feeds 210 and 212 penetrating the substrates and contacting the electrodes 250 and 254 as well as corresponding fence pins 206.

Figure 2D:
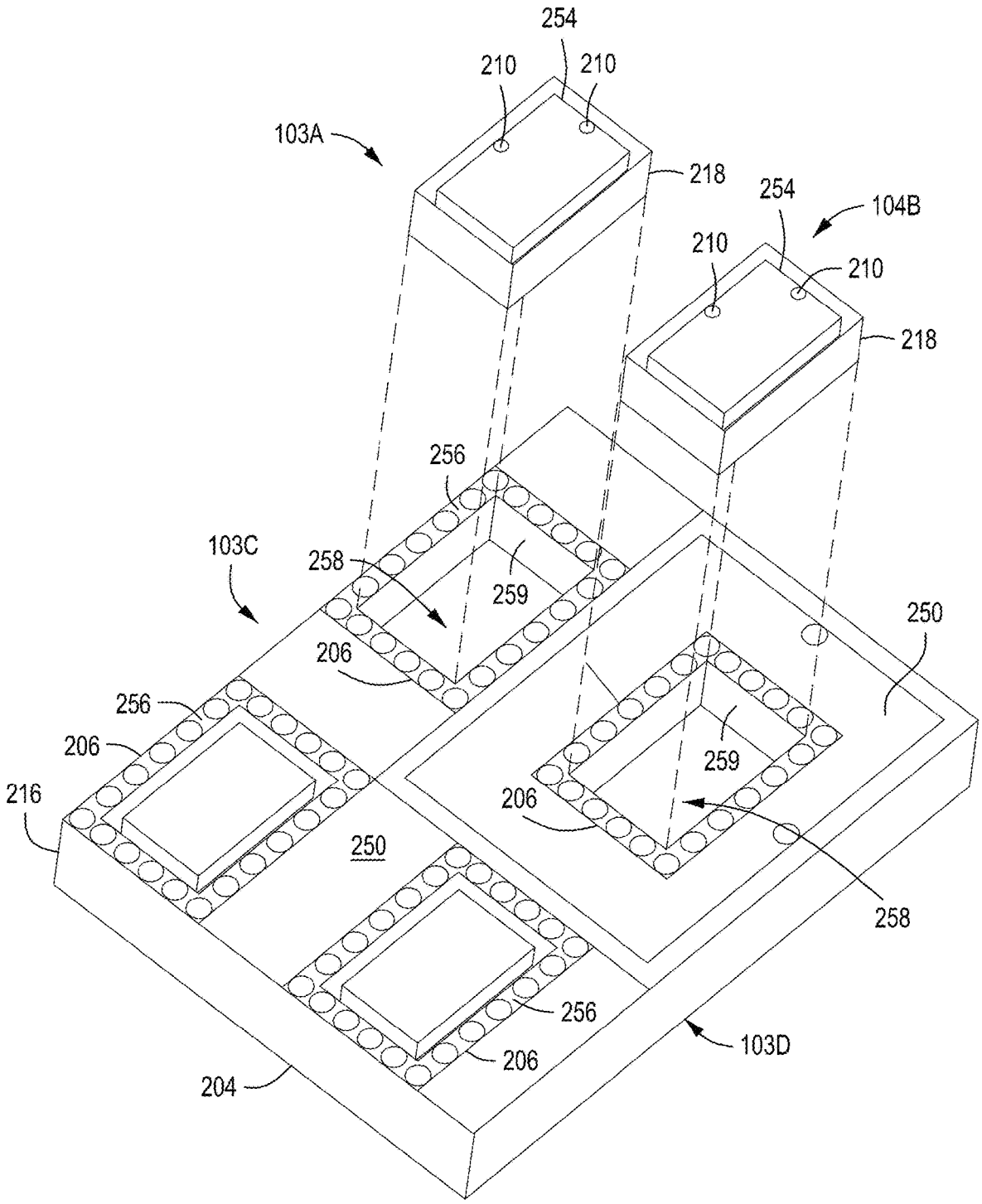
FIG. 2D depicts an partially exploded perspective view of the portion of the antenna array of FIG. 2A.

FIG. 2D depicts an exploded view of the antenna element 102 to clearly show the opening 258 formed in the low frequency substrate 216 into which the high frequency substrate 218 is placed. The ground plane electrode 204 is common to the entire array 100.

Figure 3:
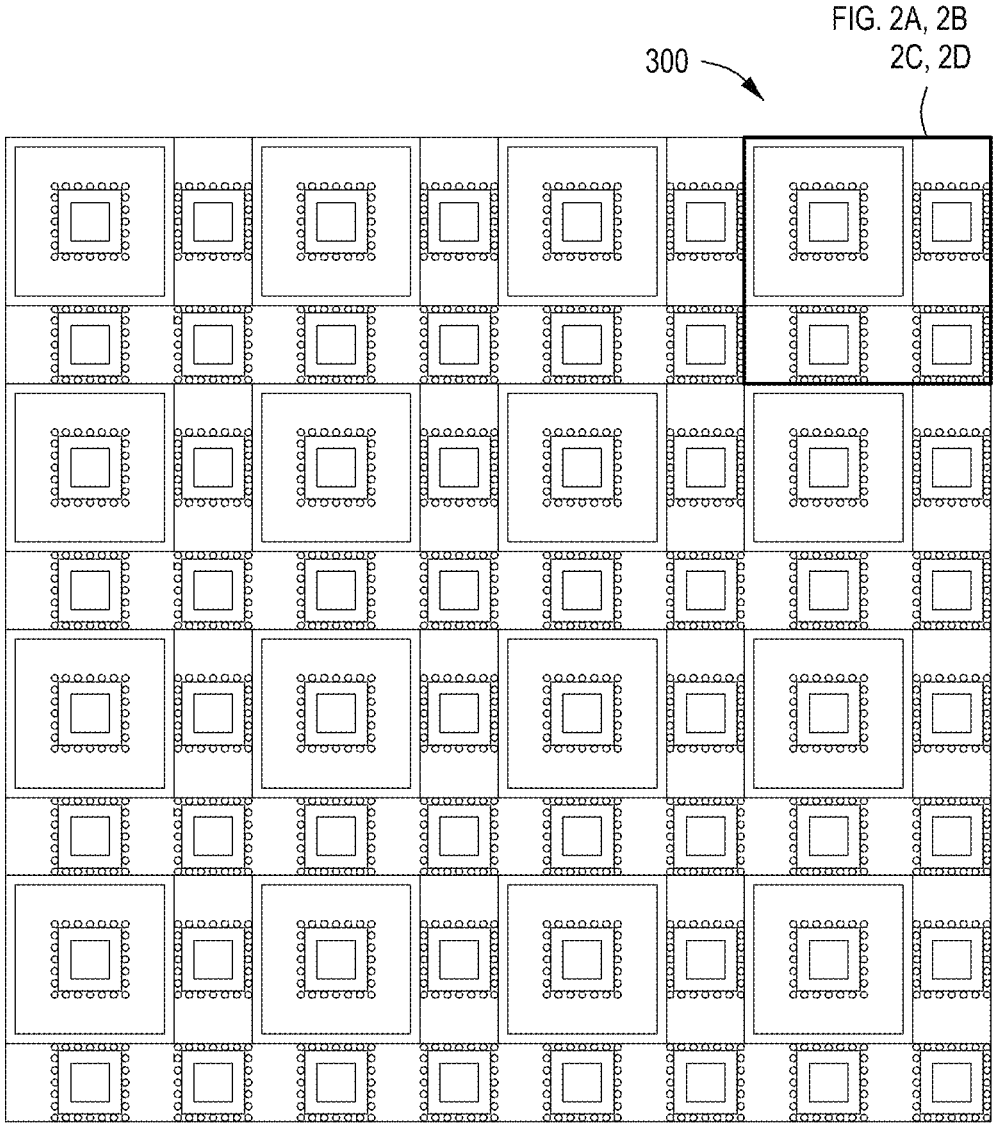
FIG. 3 depicts another embodiment of antenna array invention.

FIG. 3 depicts a top plan view of another embodiment of a concentric, collocated and interleaved antenna array of the present invention. Specifically, FIG. 3 depicts the use of the fundamental concepts of the array of FIG. 1 used to construct a larger, more complex array 300 (e.g., 4×4 S-band array co-located with an 8×8 X-band array). A simulation of the 4×4 S-band array co-located with an 8×8 X-band array of FIG. 3 for a uniform amplitude distribution across the array show 12.9 dB of realized gain at 2.9 GHz and 24.7 dB of realized gain at 10.3 GHz. All measurements are calculated at broadside of the antenna using a finite difference time domain (FDTD) solver of the CST Studio Suite 2016.

In the embodiment of FIG. 3 and referring to FIGS. 2A, 2B, 2C and 2D for the detailed construction of the array elements 102, 103, and 104, and design the embodiment to operate at S-band (low frequency) and X-band (high frequency), the low frequency substrate 216 is Rogers 3006 ($\varepsilon_r$=6.15, tan δ=0.002) and the high frequency substrate 218 is Rogers 5880 ($\varepsilon_r$=2,2, tan δ=0.001). Additionally, the pin feeds 212 are SMA pins (e.g., 1.27 mm) for the S-band and pin feeds 210 are SMP pins (e.g., 0.7 mm) for the X-hand. The pin feeds 212 are placed about 1.1 mm from the edge of the low frequency electrodes, while pin feeds 210 are positioned at the edge of the high frequency electrode. The entire array 300 is 161.2 mm×161.2 mm square, with S-band elements are spaced 40.3 mm apart and X-band elements are spaced 20.2 mm apart. For this exemplary embodiment, the electrodes are square with the S-band electrode edge length is 24.6 mm, the X-band electrode edge length is 6.1 mm, the fencing is placed in a metallization that is 13.2 mm square, and the concentric spacing between S- and X-band elements is 1.1 mm. The shorting pins of the fence surrounding the X-band element are, for example, 1.27 mm in diameter.

Simulated Performance of the Antenna Array Embodiment of FIG. 1

Figure 4:
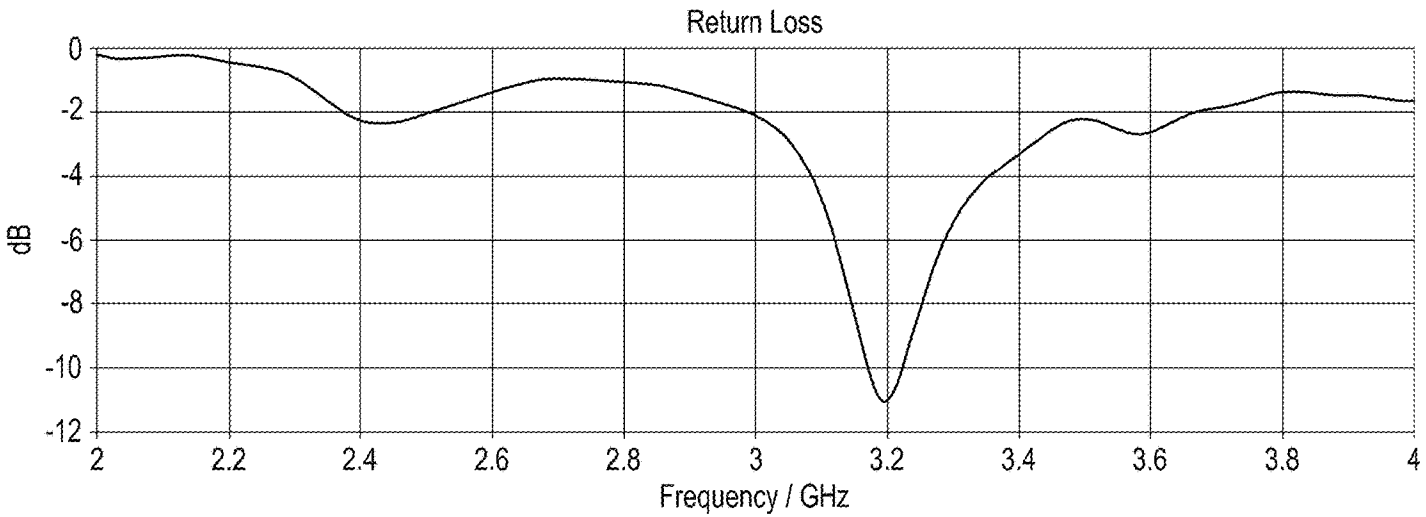
FIG. 4 is an illustration showing an example return loss and isolation at S-band of an individual element of the antenna array embodiment of FIG. 1.
Figure 4:
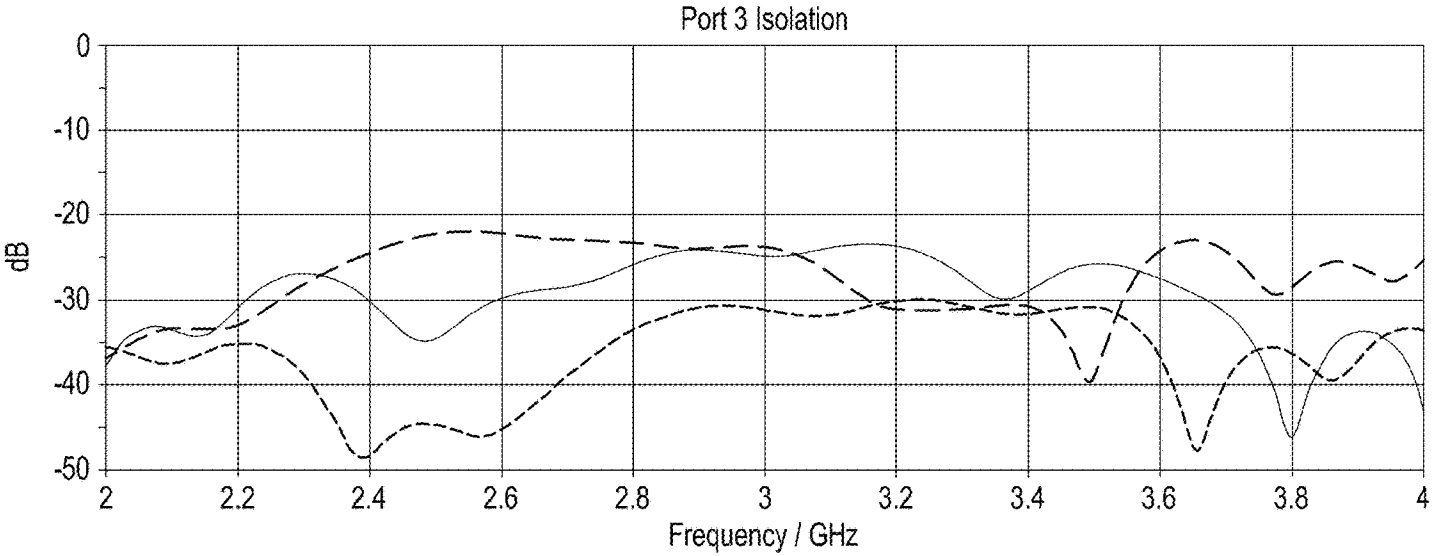
Figure 5:
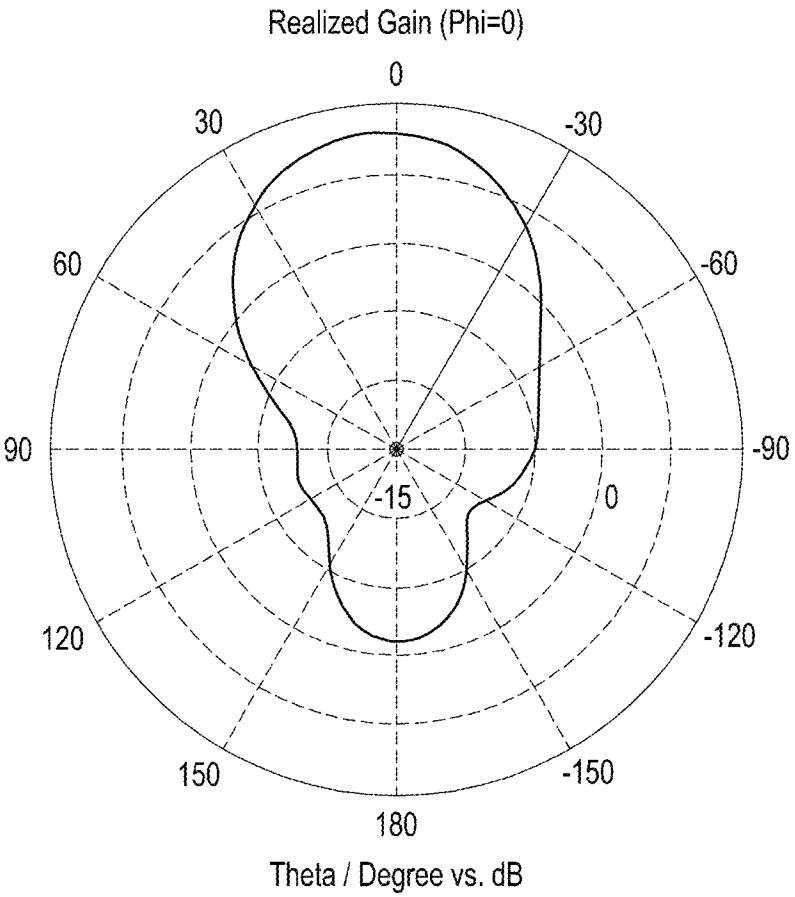
FIG. 5 is an illustration showing the gain pattern at S-band of the antenna array embodiment of FIG. 1.
Figure 5:
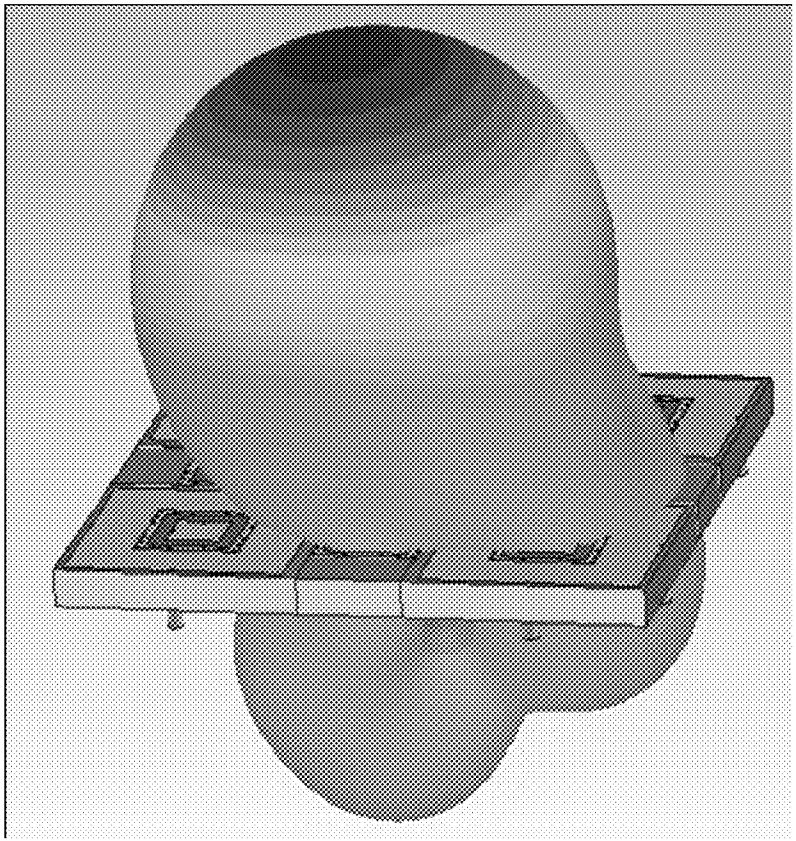

FIG. 4 shows the return loss and isolation curves for an input to one of the S-band ports of the geometry of FIG. 1. At S-band, improved isolation is expected because the elements are spaced $0.54\lambda_L$ (i.e., near optimal half-wavelength spacing). At 3.2 GHz, the return loss shows resonance, the isolation curves are all −20 dB or better indicating good isolation. The radiation patterns in FIG. 5 show 8.0 dB of realized gain to broadside, while a large amount of back radiation reduces the peak realized gain by about 3.0 dB. The back radiation stems from the fact that at S-band these are all edge elements, and the back radiation could be compensated by either increasing the size of the ground plane under the S-band elements or adding more elements to the array.

Figure 6:
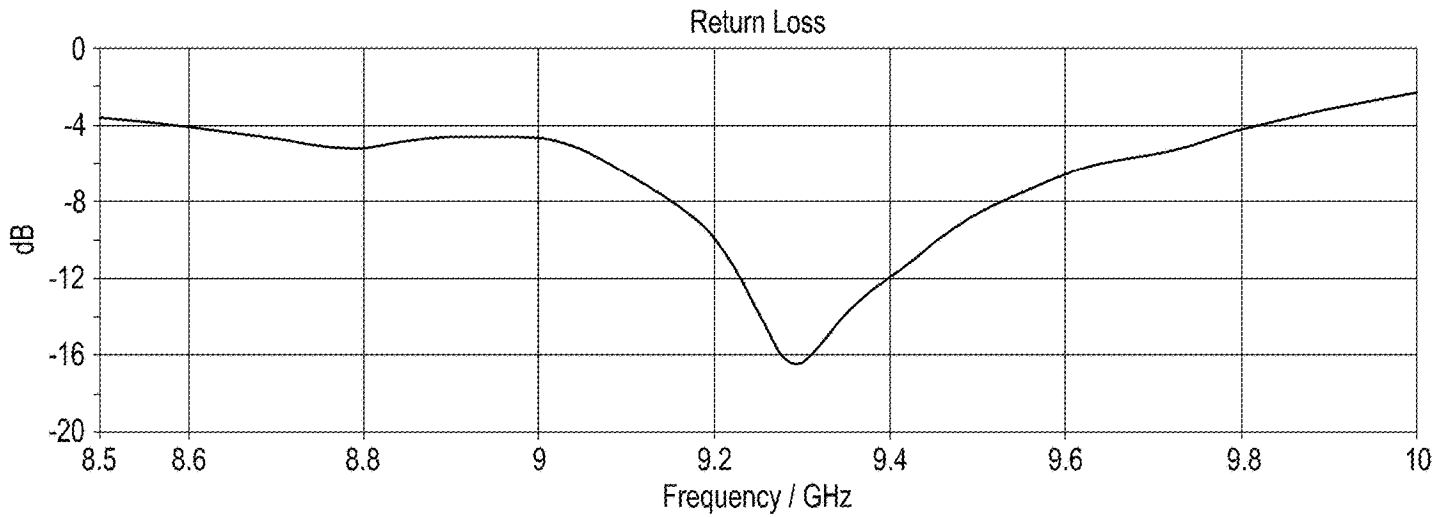
FIG. 6 is an illustration showing an example return loss and isolation at X-band of an individual element of the antenna array embodiment of FIG. 1.
Figure 6:
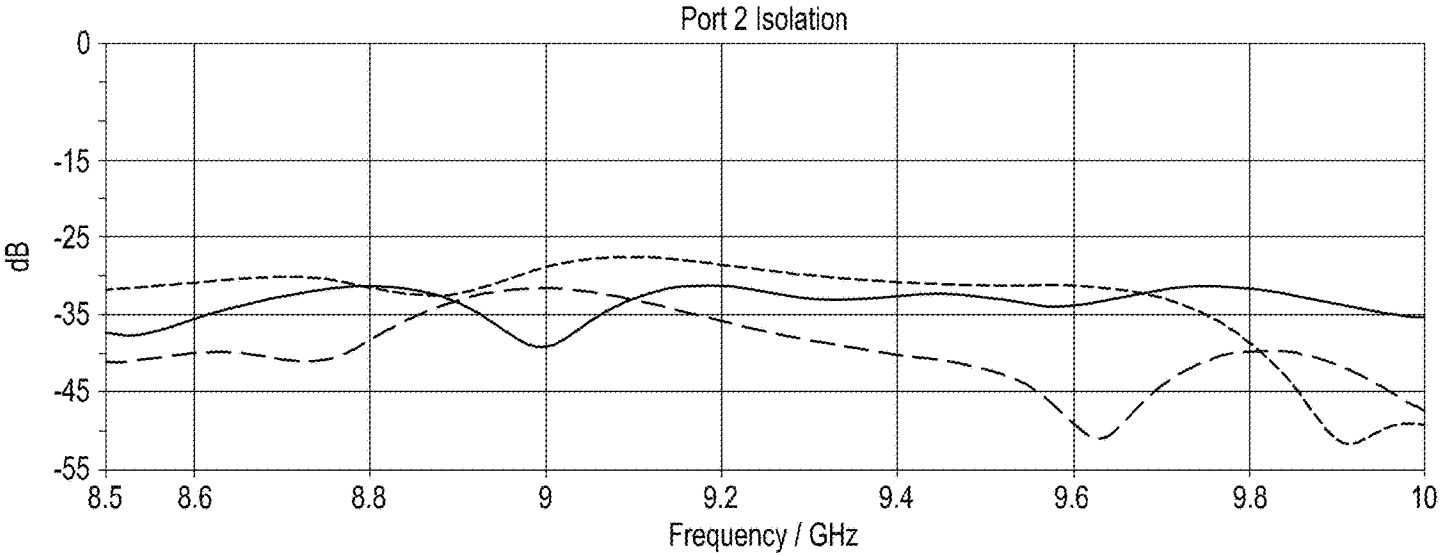
Figure 7:
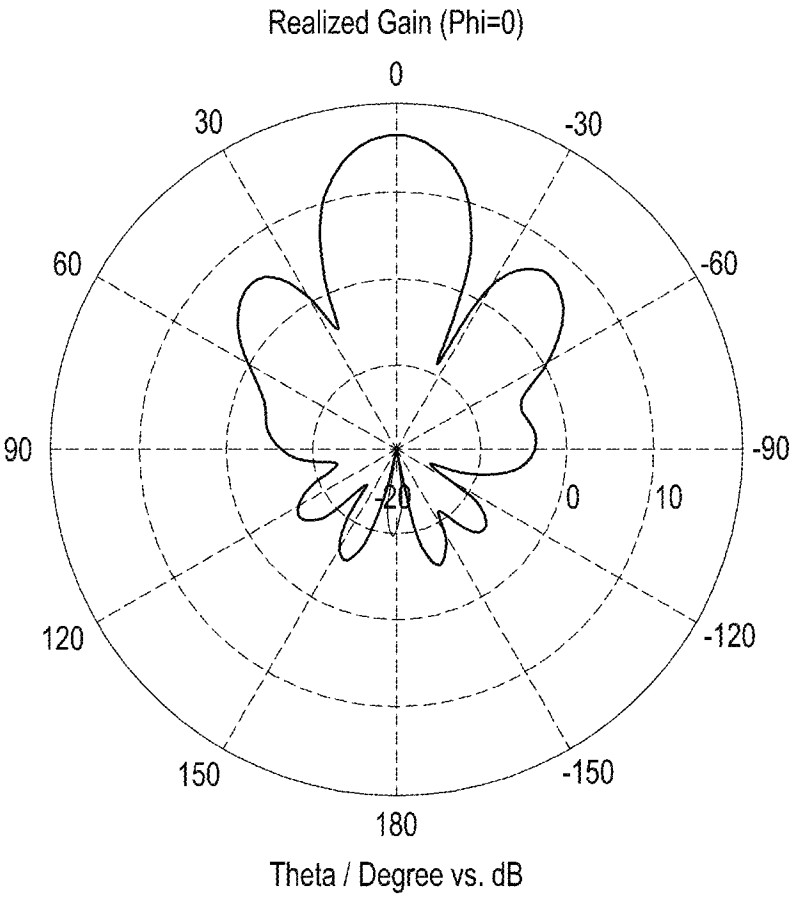
FIG. 7 is an illustration showing the gain pattern at X-band of the antenna array embodiment of FIG. 1.
Figure 7:
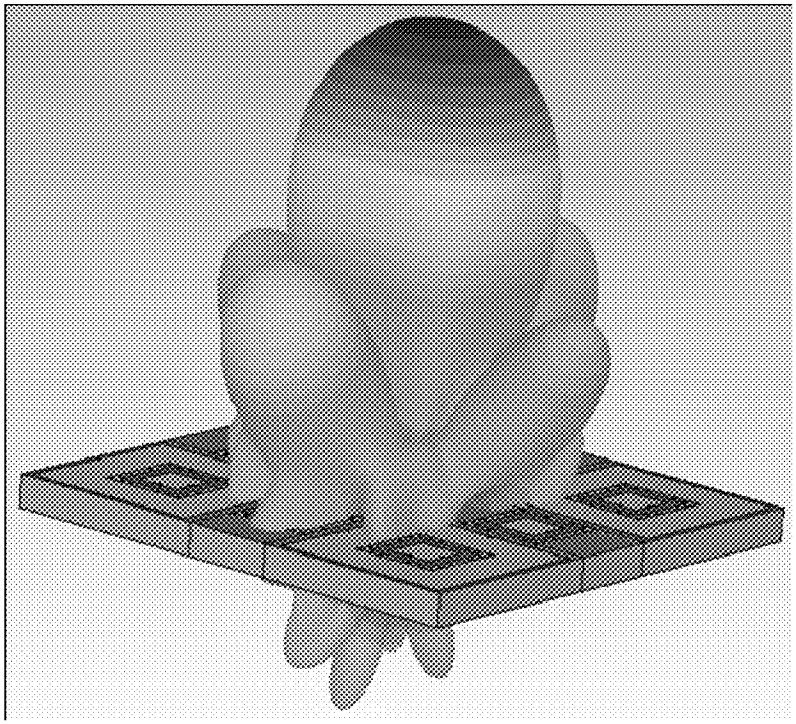

FIG. 6 shows the return loss and isolation curves for an input to one of the X-band ports of the geometry of FIG. 1. At X-band, at 9.3 GHz, where the return loss shows resonance, the isolation curves are all −25 dB or better indicating good isolation. The radiation patterns in FIG. 7 show 16.1 dB of realized gain to broadside and represent typical sidelobe levels for a uniform amplitude distribution. Note that there is much lower back radiation at X-band because the ground plane is electrically much larger than the X-band antenna elements.

Simulated Performance of the Antenna Array Embodiment of FIG. 3

Figure 8:
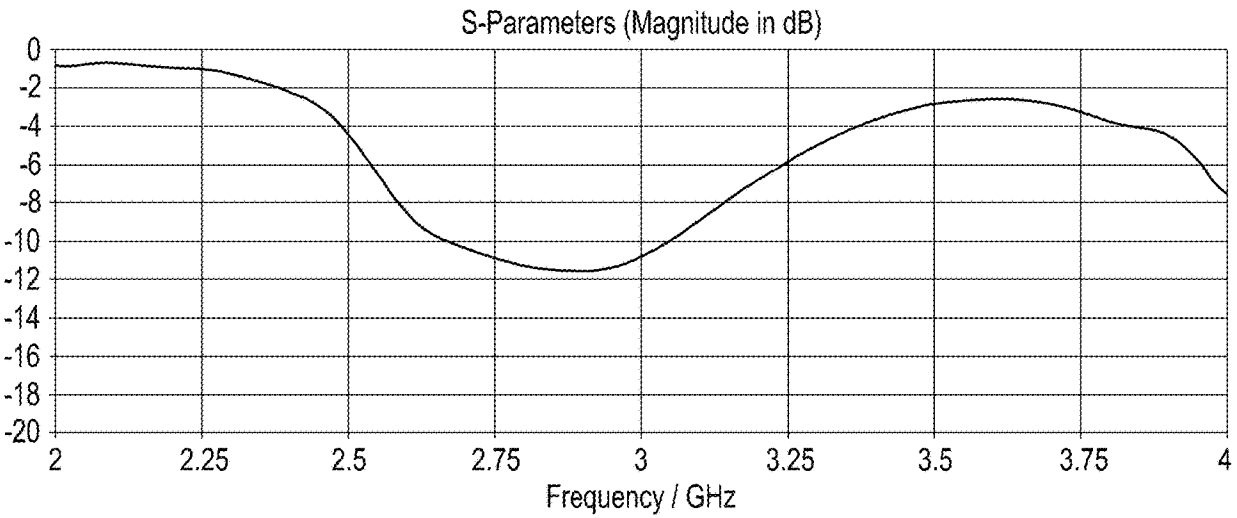
FIG. 8 is an illustration showing an example return loss and Cartesian gain pattern at S-band of the antenna array embodiment of FIG. 3.
Figure 8:
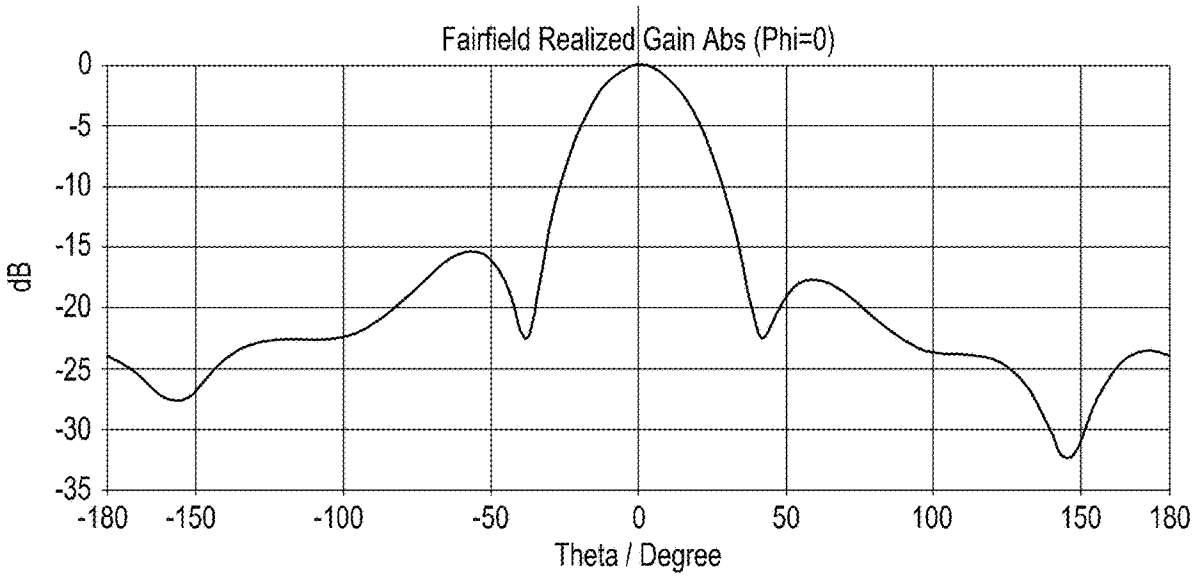
Figure 9:
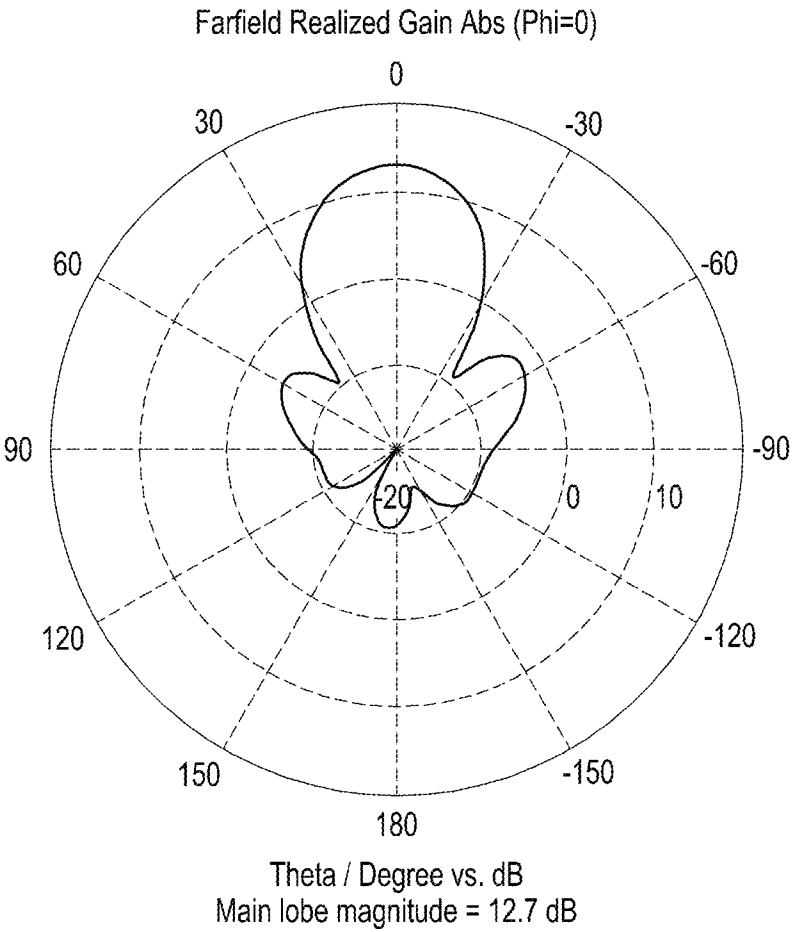
FIG. 9 is an illustration showing the 3D gain pattern and polar gain pattern at S-band of the antenna array embodiment of FIG. 3.
Figure 9:
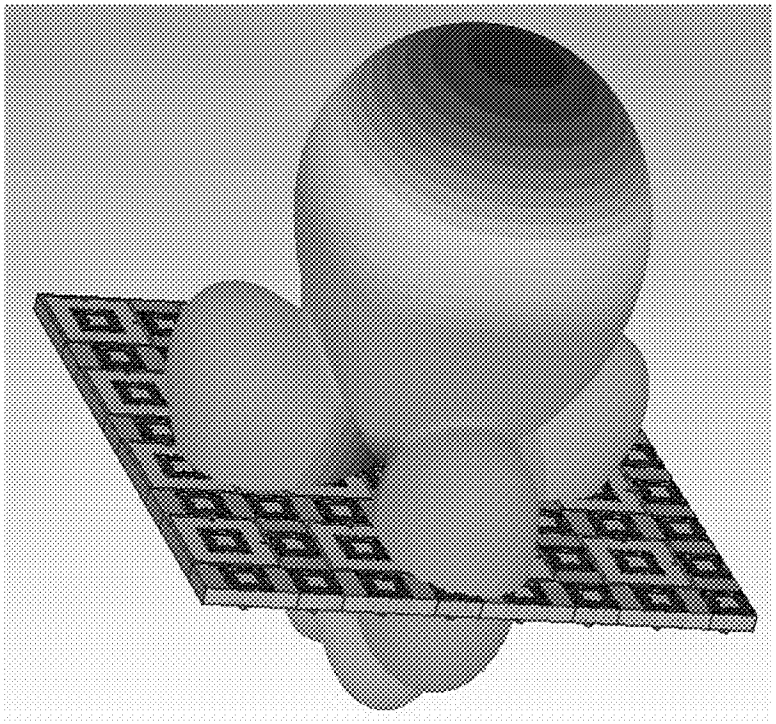

This section describes the performance of a larger antenna array utilizing the geometry shown in FIG. 3. A roughly 3 dB increase in gain (not taking into account impedance mismatch) is expected each time the number of radiating elements at each band is doubled. The geometry in FIG. 3 have 16 S-band elements and 64 X-band elements. This is due to the fact that the co-located nature of the geometry yields 4 X-band elements for every S-band element, and this geometry is expected to manifest itself in an approximate increase in gain of 6.0 dB. FIG. 8 shows the return loss and normalized E-plane cut of the radiation pattern for the combined input to 16 of the S-band ports. Note that the size of the annular rings have been tuned to maintain a resonance closer to 3.0 GHz versus that of embodiment of FIG. 1. At 2.9 GHz the return loss shows a resonance of nearly −12 dB. The normalized radiation pattern shows sidelobe levels of −15 dB versus peak gain. FIG. 9 shows the non-normalized 3D radiation pattern (left) and the E-plane cut of the polar radiation pattern (right). Both show a peak realized gain of approximately 12.9 dB and a reduction in the back radiation due to the increased size of the ground plane.

Figure 10:
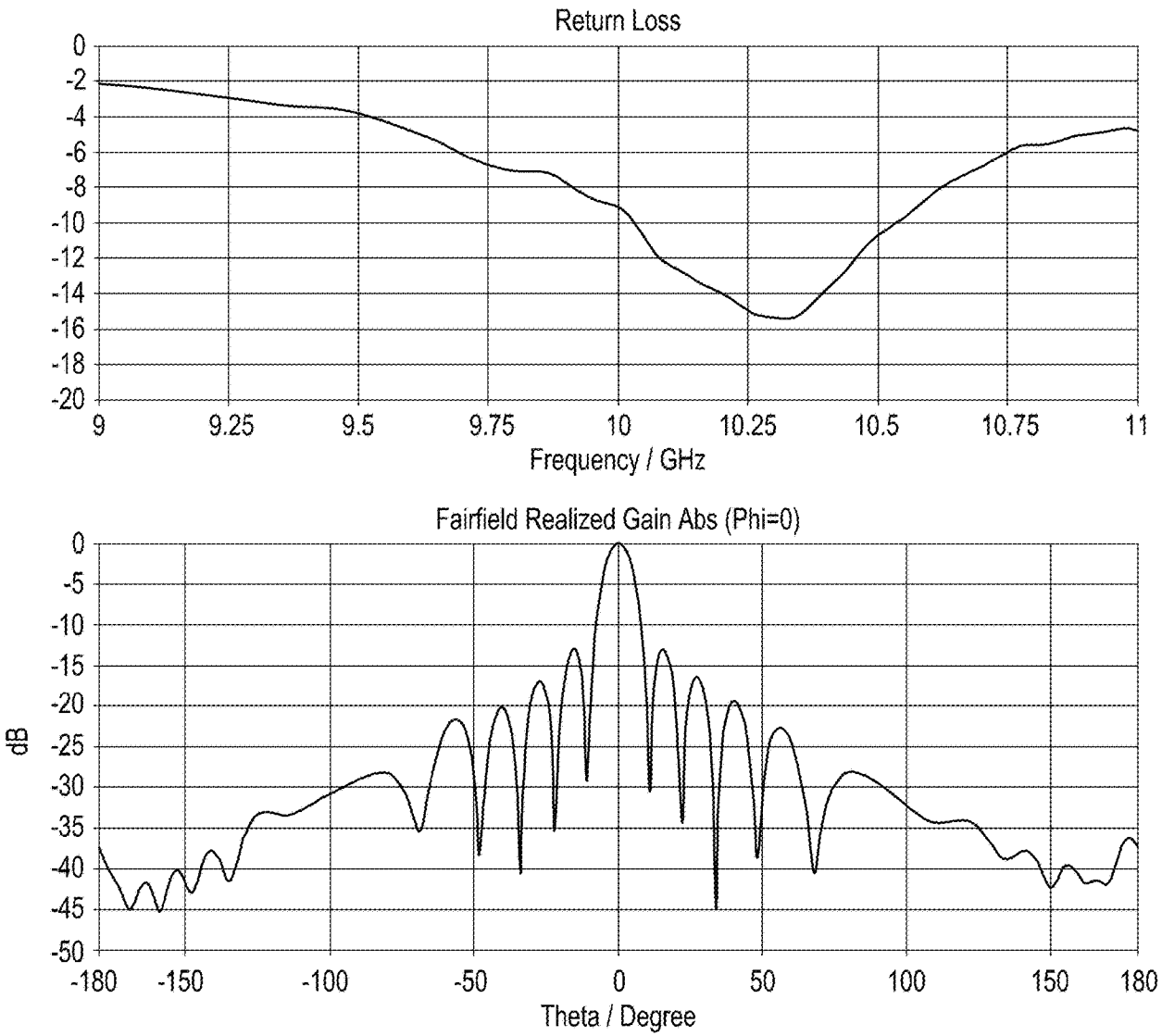
FIG. 10 is an illustration showing an example return loss and Cartesian gain pattern at X-band of the antenna array embodiment of FIG. 3.

FIG. 10 shows the return loss and normalized E-plane cut of the radiation pattern for the combined input to 64 of the X-band ports. Note that the size of the patch and slot have been left to maintain a resonance of 10.3 GHz. At 10.3 GHz, the return loss shows a resonance of −15 dB. The normalized radiation pattern shows sidelobe levels of −13 dB versus peak gain.

Figure 11:
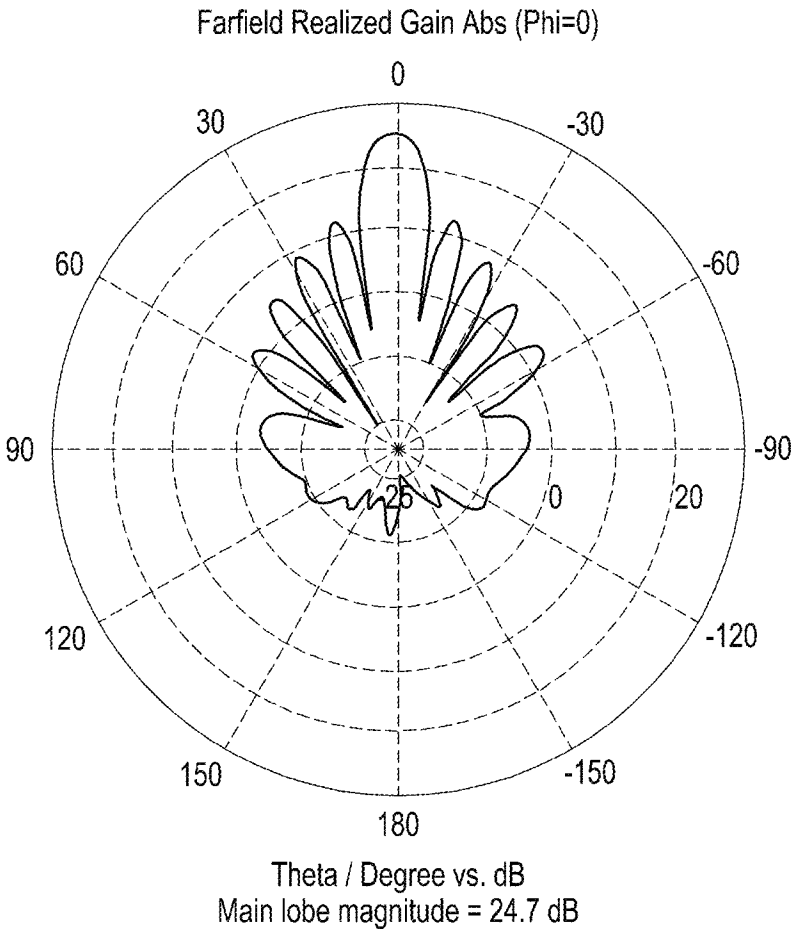
FIG. 11 is an illustration showing the 3D gain pattern and polar gain pattern at X-band of the antenna array embodiment of FIG. 3.
Figure 11:
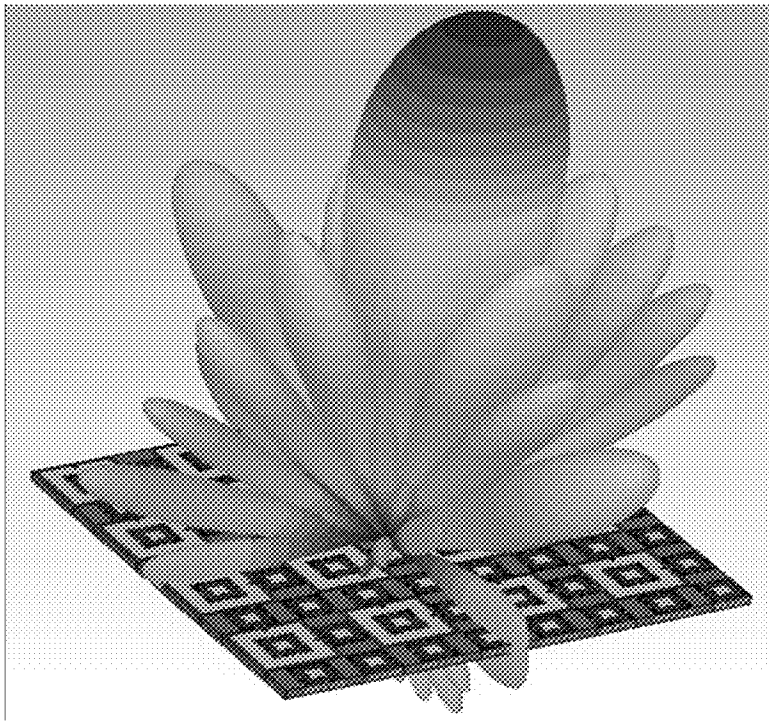

FIG. 11 shows the non-normalized 3D radiation pattern and the E-plane cut of the polar radiation pattern. Both show a peak realized gain of approximately 24.7 dB.

One advantage of the invention over presently known devices, systems or processes is that by including 4 X-band elements for every S-band element, the number of bands over a traditional S-band array has been increased without increasing the antenna footprint. The isolation between the two bands is good enough using the novel geometry that the array can be used to transmit or receive at both frequency bands simultaneously. There is no degradation in performance by implementing this dual band approach. While this approach focuses only on S-band and X-band elements this is only a demonstration of the concept. This design could be scaled to any two frequency bands.

The invention claimed is:

1. An antenna array comprising:

a plurality of concentric low frequency elements, where each low frequency element circumscribes a first high frequency element; and a plurality of second high frequency elements interleaved with the plurality of concentric low frequency elements wherein the low frequency element is adapted to operate in the S-band and the first and second high frequency elements are adapted to operate in the X-band wherein the plurality of low frequency elements are spaced $0.54\lambda_L$ apart from each adjacent low frequency element and the plurality of first and second high frequency elements are spaced $0.72\lambda_H$ apart from each adjacent high frequency element, where $\lambda_L$ is a wavelength of a nominal operating frequency of the low frequency element and $\lambda_H$ is a wavelength of a nominal operating frequency of the high frequency elements.

2. The antenna array of claim 1 wherein the concentric low frequency elements and the first and second high frequency elements comprise a dielectric substrate sandwiched between an active electrode and a ground plane electrode, wherein the dielectric constant of the dielectric substrate of the first and second high frequency elements is 2.2 and the dielectric constant of the dielectric substrate of the concentric low frequency elements is 6.15.

* * * * *